US007119767B1

(12) United States Patent
Komiya et al.

(10) Patent No.: US 7,119,767 B1
(45) Date of Patent: Oct. 10, 2006

(54) ACTIVE MATRIX TYPE ELECTROLUMINESCENCE DISPLAY DEVICE

(75) Inventors: Naoaki Komiya, Ogaki (JP); Masahiro Okuyama, Inazawa (JP)

(73) Assignee: Sanyo Electric Co., Ltd., (JP)

( * ) Notice: Subject to any disclaimer, the term of this patent is extended or adjusted under 35 U.S.C. 154(b) by 308 days.

(21) Appl. No.: 09/671,843

(22) Filed: Sep. 27, 2000

(30) Foreign Application Priority Data

Sep. 29, 1999 (JP) ..... 11-277086

(51) Int. Cl.
*G09G 3/30* (2006.01)

(52) U.S. Cl. ..... 345/76; 345/45; 345/100; 315/169.3

(58) Field of Classification Search ..... 345/76–82, 345/35–36, 45, 100; 315/169.1, 169.3, 169.4
See application file for complete search history.

(56) References Cited

U.S. PATENT DOCUMENTS 4,837,566 A * 6/1989 Channing et al. ..... 340/781
5,973,456 A * 10/1999 Osada et al. ..... 315/169.1
6,072,450 A * 6/2000 Yamada et al. ..... 345/76
6,078,142 A * 6/2000 Peng et al. ..... 315/169.1
6,147,451 A * 11/2000 Shibata et al. ..... 313/506
6,169,528 B1 * 1/2001 Oguchi et al. ..... 345/74
6,366,026 B1 * 4/2002 Saito et al. ..... 315/169.1
6,421,034 B1 * 7/2002 Mihara ..... 345/76
6,518,941 B1 * 2/2003 Kimura ..... 345/55
6,618,029 B1 9/2003 Ozawa

FOREIGN PATENT DOCUMENTS

JP 10-268350 10/1998
JP 11-24606 1/1999

OTHER PUBLICATIONS

Notice of Grounds for Rejection for Japanese Patent Application No. Hei 11-277086 dated Jun. 1, 2004.

* cited by examiner

*Primary Examiner*—Richard Hjerpe
*Assistant Examiner*—Kimnhung Nguyen
(74) *Attorney, Agent, or Firm*—Cantor Colburn LLP

(57) ABSTRACT

An active matrix type electroluminescence display device is provided which comprises a plurality of display pixels GS11, GS12, GS13, arranged in a matrix of rows and columns; gate signal lines GL1, GL2, Gli connected to and shared by a plurality of display pixels arranged in each row; and gate drive circuits for sequentially supplying a select signal SCAN to the gate signal lines GL1, GL2, GL3, Gli. Each display pixel includes an electroluminescence element, a first thin film transistor in which a display signal DATA is applied to the drain and which is switched on and off in response to the select signal SCAN, and a second thin film transistor for driving the EL element based on the display signal DATA. The gate drive circuits are placed so that each of the gate signal lines GL1, GL2, GL3, Gli is driven from both ends.

15 Claims, 2 Drawing Sheets

ACTIVE MATRIX TYPE ELECTROLUMINESCENCE DISPLAY DEVICE

BACKGROUND OF THE INVENTION

1. Field of the Invention

The present invention relates to an active matrix type EL display device with display pixels including an electroluminescence element (hereinafter referred to as an EL element) and a thin film transistor arranged in a matrix form, and particularly to an art for stably illuminating each display pixel preventing select signals in gate signal lines connected to and shared by the display pixels from being delayed.

2. Description of the Related Art

EL elements have various advantages, including, because they are self illuminating elements, an obviated need for a backlight as required in liquid crystal display devices and unlimited viewing angle. Because of these advantages, it is widely expected that EL elements will be use in the next generation of display devices.

Two basic methods are known for driving EL elements. One of these is called a simple, or passive, matrix type, with the other, which employs a thin film transistor as a switching element, is known as an active matrix type. The active matrix type does not suffer from cross talk between the column and row electrodes, which is a problem known in the simple matrix type. Moreover, because the EL elements are driven with a lower current density, a high luminescence efficiency can be expected.

FIG. 3 is a circuit diagram schematically showing an active matrix type EL display device. In the figure, the display pixels GS1, GS2, GS3, . . . GSj are arranged in one row. One display pixel GS1 includes an organic EL element 11, a first thin film transistor 12 (an N channel type transistor) acting as a switching element in which a display signal DATA1 is applied to the drain and which is switched on and off in response to a select signal SCAN, a capacitance 13 which is charged by the display signal DATA1 supplied when the first thin film transistor 12 is switched on and which maintains a maintenance voltage Vh when the first thin film transistor 12 is switched off, and a second thin film transistor 14 (a P channel type transistor), with its drain connected to a drive supply voltage Vdd and its source connected to the anode of the organic EL element 11, for driving the organic EL element when the maintenance voltage Vh is supplied from the capacitance 13 at the gate.

The other display pixels GS2, GS3, . . . GSj have an equivalent structure. Although the display pixels are also arranged in the column direction, this arrangement is not shown in order to simplify the drawing. Reference numeral 15 represents a gate signal line which is connected to and shared by each of the display pixels GS1, GS2, GS3, . . . GSj for supplying a select signal SCAN. Reference numeral 16 represents a gate drive circuit for supplying the select signal SCAN to the gate signal line.

The select signal SCAN becomes H level during a selected one horizontal scan period (1H), and the first thin film transistor 12 is then switched on based on the select signal. Next, a display signal DATA1 is supplied to one end of the capacitance 13 and the capacitance 13 is charged with a voltage Vh corresponding to the display signal DATA1. The voltage Vh is maintained in the capacitance 13 for a period of one vertical scan period (1V) even after the first thin film transistor 12 is switched off due to the select signal SCAN becoming L level. Because this voltage is supplied to the gate of the second thin film transistor 14, the second thin film transistor 14 becomes continuous in response to the voltage Vh and the organic EL element 11 is illuminated.

However, in larger size conventional EL display devices, differences in luminance throughout the display device have been observed.

The gate signal line 15 is formed from chrome evaporated on a glass substrate, in consideration of heat endurance and ease of processing. Because the gate signal line 15 is extended on the display region in order to be connected to and shared by each of the display pixels GS1, GS2, GS3, . . . GSj, a resistance and a floating capacitance are inevitably generated. For example, in an active matrix type EL display device having a number of pixels of 220×848, the resistance value of one gate signal line 15 is approximately 320Ω and the floating capacitance is approximately 20 pf. The resistance and floating value increase as the number of pixels increases.

Therefore, due to signal transmission delay, it is difficult to sufficiently increase the signal level to H level at the further end of the gate signal line 15 which is far apart from the gate drive circuit 16 when supplying a select signal SCAN of H level to the gate signal line 15 based on the select signal SCAN. It is found that due to this insufficient voltage increase in signal line, the signal level of a display signal DATAn cannot be fully transferred to the capacitance 13 at display pixels in the end section, causing a decrease in the illuminating luminescence of the organic EL element, and therefore, the overall luminescence of the display device becomes unstable.

SUMMARY OF THE INVENTION

The present invention stabilizes luminance among the display pixels by minimizing delay in the select signal SCAN on the gate signal line connected to and shared by each of the display pixels.

According to one aspect of the present invention, there is provided an active matrix type EL display device comprising a plurality of display pixels arranged in a matrix form in rows and columns, gate signal lines each of which is connected to and shared by a plurality of display pixels provided for each row, and gate drive circuits for sequentially supplying select signals to the gate signal lines, wherein, each of the display pixels includes an EL element, a first thin film transistor in which a display signal is applied to the drain and which is switched on and off in response to the select signal, and a second thin film transistor for driving the EL element based on the display signal, and wherein the gate drive circuits are placed so that the select signal is supplied on each of the gate signal lines from both ends of the gate signal lines.

With this structure, because the gate drive circuits are placed to drive each of the gate signal lines from both ends, the select signal can be more rapidly supplied to the gate signal lines compared to the conventional method, and thus, each of the display pixels can be illuminated at a stable luminance.

DESCRIPTION OF THE PREFERRED EMBODIMENT

An active matrix type EL display device according to a preferred embodiment of the present invention is described hereinafter referring to FIGS. 1 and 2.

Figure 1:
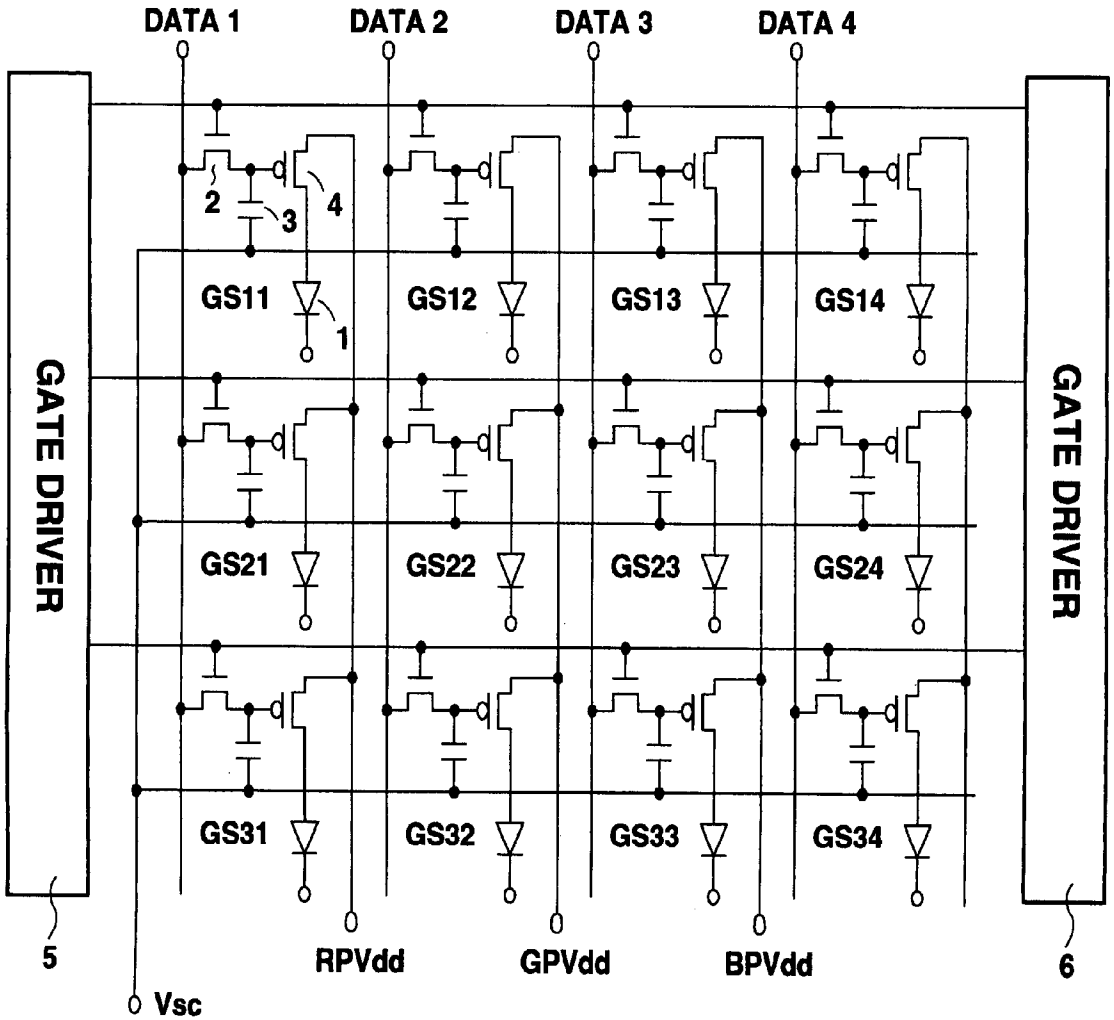
FIG. 1 is a figure illustrating an active type electroluminescence display device according to one embodiment of the present invention.

FIG. 1 is a circuit diagram schematically showing a structure of an active matrix type EL display device. Display pixels GS11, GS12, GS13, . . . GSij, are arranged in rows and columns to form a matrix. Each of the display pixels includes an organic EL element 1, a first thin film transistor 2 in which a display signal DATAj is applied to the drain and which is switched on and off in response to a select signal supplied from a gate signal line GLi, a capacitance 3, and a second thin film transistor 4 for driving the EL element 1 based on the display signal DATAj. One end of the capacitance 3 is connected to a common electrode and biased to a constant voltage of Vsc.

FIG. 1 shows a full-color EL display device and three types of display pixels are repeatedly arranged, each type of display pixel having an organic EL element illuminating respectively in red (R), green (G), and blue (B). In other words, a common drive voltage source RPVdd is supplied to the display pixels GS11, GS21, GS31, . . . GSi1 having organic EL elements illuminating in red, a common drive voltage source GPVdd is supplied to the display pixels GS12, GS22, GS32, . . . GSi2, having green illuminating organic EL elements, and a common drive voltage source BPVdd is supplied to the display pixels GS13, GS23, GS33, . . . GSi3, for blue illuminating organic EL elements. A monochrome EL display device can be constructed by arranging display pixels of one type in rows and columns.

A display signal DATA1 is applied to the display pixels arranged in the first column such as GS11, GS21, and GS31; a display signal DATA2 is applied to the display pixels arranged in the second column such as GS12, GS22, and GS32; and so on such that a display signal DATAj is applied to the display pixels arranged in the jth column such as GS1*j*, GS2*j*, and GS3*j*.

A common gate signal line GL1 is connected to the display pixels arranged in the first row such as GS11, GS12, and GS13; a common gate signal line GL2 is connected to the display pixels arranged in the second row such as GS21, GS22, and GS23; and so on such that a common gate signal line GLi is connected to the display pixels arranged in the ith row such as GSi1, GSi2, and GSi3.

A characteristic of the present invention is that a pair of gate drive circuits 5 and 6 are provided to supply a select signal SCAN to each of the gate signal lines such as GL1, GL2, and GL3 from both ends of the respective gate signal line. The gate drive circuits 5 and 6 are placed symmetrically in the right and left directions with respect to the display region. The gate signal lines such as GL1, GL2, and GL3 are connected to and shared by, for example, 848 display pixels. Because the gate signal lines are formed of an evaporated chrome thin film with a line width of approximately 4μ, they have large resistance and floating capacitance values. According to the present invention, any delay of the select signal SCAN transmitted on the gate signal lines such as GL1, GL2, and GL3 can be minimized; the select signal SCAN can be sufficiently increased to H level; and, thus, the illumination intensity of the EL element in the display pixels can be unified. Also, because the signal level of the display signals DATAj can be reliably transmitted to the capacitance 13, a decrease in the luminance of the organic EL element can be prevented.

Figure 2:
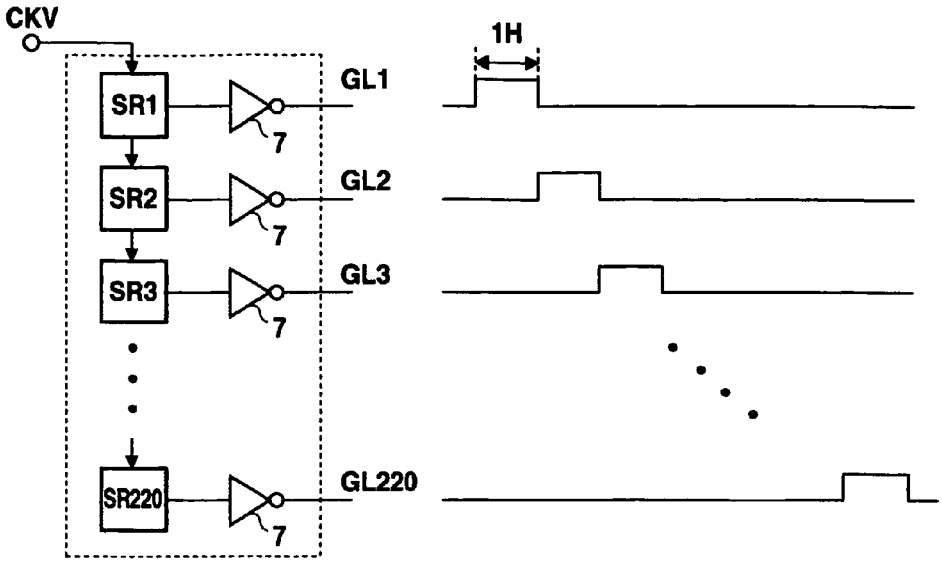
FIG. 2 is a circuit diagram illustrating a gate drive circuit according to the embodiment of the present invention.
Figure 3:
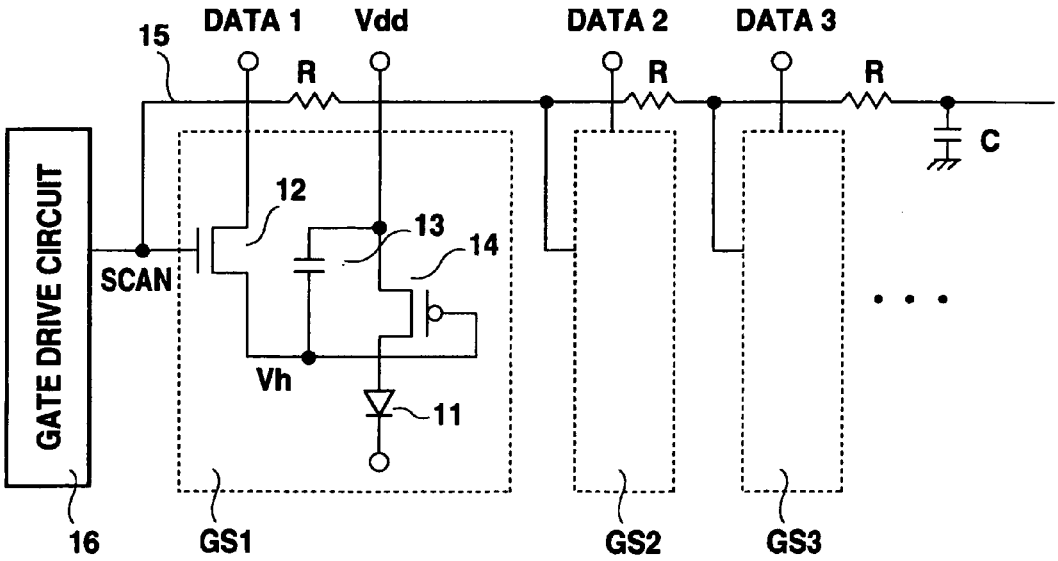
Fig. 3 PRIOR ART
FIG. 3 is a diagram illustrating a conventional active type EL display device.

FIG. 2 is a circuit diagram showing a structure of the gate drive circuits 5 and 6. A reference clock CKV is supplied from outside. A plurality of shift registers SR1 through SR220 are serially connected to sequentially shift the reference clock CKV by one horizontal scan period (1H). The select signal SCAN, which is the output of each of the shift registers, is transmitted to each of the gate signal lines GL1 through GL220 via buffer amplifiers 7.

In other words, each of the select signals SCAN having a pulse width of one horizontal scan period (1H), is shifted by each of the shift registers SR1 through SR220 and is output sequentially through each of the gate signal lines GL1 through GL220. The number of shift registers provided is 220 to correspond to the number of pixels of 220×848 in the active matrix type EL display device in the example of this embodiment. However, the numbers of shift registers and of the buffer amplifiers can be modified to suit and correspond to the number of rows of display pixels.

The active matrix type EL display device is driven as follows. When a gate signal line GL1 is selected by a select signal SCAN, the display pixels in the first row such as GS11, GS21, and GS31 are selected. At this point, because the gate signal line GL1 is driven from both ends, the signal can be quickly increased to the H level.

During one horizontal scan period (1H), display signals DATA1, DATA2, DATA3, . . . DATAj are sequentially supplied to each of the display pixels GS11, GS12, GS13, . . . GS1*j* from each of the data lines. The display signals DATA1, DATA2, DATA3, . . . DATAj are maintained by a sampling circuit (not shown) and the timing for outputting the signals is controlled via a transfer gate provided for each of the display signal terminals. The EL element 1 in each of the display pixels GS11, GS12, GS13, . . . Gs1*j*, is stably illuminated at a luminance corresponding to the respective one of display signals DATA1, DATA2, DATA3, . . . DATAi. Similarly, gate signal line GL2 is selected by the next select signal SCAN. These steps are repeated for one vertical scan period (1V).

As described, according to the present invention, by minimizing delay in the select signal on the gate signal line connected to and shared by each of the display pixels, an active matrix type EL display device in which each pixel electrode illuminates at a stable luminance can be provided.

What is claimed is:

1. An active matrix type electroluminescent display device comprising:

a plurality of display pixels arranged in rows and columns in a matrix form;

gate signal lines, each of which is connected to and shared by a plurality of display pixels provided on each row;

gate drive circuits for sequentially supplying select signals to said gate signal lines;

voltage source lines, each of which is connected to and shared by a plurality of display pixels provided on each column; and voltage from a drive voltage source is provided to each of said columns from only one end of said voltage source lines, wherein each of said display pixels includes an electroluminescence element, a first thin film transistor in which a display signal is applied to the drain and which is switched on and off in response to said select signal, and a second thin film transistor for driving said electroluminescence element based on said display signal; and said gate drive circuits are placed so that said select signals are supplied from both ends of said gate signal lines, each of said gate signal lines is connected to said gate drive circuits at both ends of said gate signal lines.

2. An active matrix type electroluminescence display device according to claim 1, wherein said gate drive circuits include a first and second gate drive circuits arranged in a symmetric pattern to the right and left of a display region constructed from said plurality of display pixels.

3. An active matrix type electroluminescence display device according to claim 2, wherein each of said first and second gate drive circuits includes a plurality of shift registers for sequentially shifting a reference clock with a pulse width of one horizontal period.

4. An active matrix type electroluminescence display device according to claim 3, wherein each of said first and second gate drive circuits includes buffer amplifiers for driving said gate signal lines based on the output of said shift registers.

5. An active matrix type electroluminescence display device according to claim 4, wherein the number of said shift registers and of the buffer amplifiers included in each of said first and second gate drive circuits corresponds to the number of rows of said plurality of display pixels.

6. An active matrix type electroluminescence display device comprising:

a plurality of display pixels arranged in rows and columns in a matrix form;

gate signal lines, each of which is connected to and shared by a plurality of display pixels provided on each row;

gate drive circuits for sequentially supplying select signals to said gate signal lines;

a data line is provided for each column; and a data signal is provided to each of said columns from only one end of said data line; wherein each of said display pixels includes an electroluminescence element, a first thin film transistor in which a display signal is applied to the drain and which is switched on and off in response to said select signal, and a second thin film transistor for driving said electroluminescence element based on said display signal; and said gate drive circuits are placed so that said select signals are supplied from both ends of said gate signal lines to said gate signal lines, each of said gate signal lines is connected to said gate drive circuits at both ends of said gate signal lines.

7. An active matrix type electroluminescence display device according to claim 6, wherein said gate drive circuits include a first and second gate drive circuits arranged in a symmetric pattern to the right and left of a display region constructed from said plurality of display pixels.

8. An active matrix type electroluminescence display device according to claim 7, wherein each of said first and second gate drive circuits includes a plurality of shift registers for sequentially shifting a reference clock with a pulse width of one horizontal period.

9. An active matrix type electroluminescence display device according to claim 8, wherein each of said first and second gate drive circuits includes buffer amplifiers for driving said gate signal lines based on the output of said shift registers.

10. An active matrix type electroluminescence display device according to claim 9, wherein the number of said shift registers and of the buffer amplifiers included in each of said first and second gate drive circuits corresponds to the number of rows of said plurality of display pixels.

11. An active matrix type electroluminescence display device comprising:

a plurality of display pixels arranged in rows and columns in a matrix form;

gate signal lines, each of which is connected to and shared by a plurality of display pixels provided on each row;

gate drive circuits for sequentially supplying select signals to said gate signal lines;

a voltage source line and a data line are provided for each column; and voltage from a voltage source is provided to each of said columns from only one end of said voltage source line and a data signal is provided to each of said columns from only one end of said data line; wherein each of said display pixels includes an electroluminescence element, a first thin film transistor in which a display signal is applied to the drain and which is switched on and off in response to said select signal, and a second thin film transistor for driving said electroluminescence element based on said display signal; and said gate drive circuits are placed so that said select signals are supplied from both ends of said gate signal lines to said gate signal lines, each of said gate signal lines is connected to said gate drive circuits at both ends of said gate signal lines.

12. An active matrix type electroluminescence display device according to claim 11, wherein said gate drive circuits include a first and second gate drive circuits arranged in a symmetric pattern to the right and left of a display region constructed from said plurality of display pixels.

13. An active matrix type electroluminescence display device according to claim 12, wherein each of said first and second gate drive circuits includes a plurality of shift registers for sequentially shifting a reference clock with a pulse width of one horizontal period.

14. An active matrix type electroluminescence display device according to claim 13, wherein each of said first and second gate drive circuits includes buffer amplifiers for driving said gate signal lines based on the output of said shift registers.

15. An active matrix type electroluminescence display device according to claim 14, wherein the number of said shift registers and of the buffer amplifiers included in each of said first and second gate drive circuits corresponds to the number of rows of said plurality of display pixels.

* * * * *